US009919833B2

(12) United States Patent
Jian et al.

(10) Patent No.: US 9,919,833 B2
(45) Date of Patent: Mar. 20, 2018

(54) COLLAPSIBLE CONTAINER

(71) Applicant: SHANGHAI HONGYAN RETURNABLE TRANSIT PACKAGINGS CO., LTD., Shanghai (CN)

(72) Inventors: Yuanli Jian, Shanghai (CN); Wenjing Wei, Shanghai (CN); Kai Gong, Shanghai (CN)

(73) Assignee: Shanghai Hongyan Returnable Transit Packagings Co., Ltd., Shanghai (CN)

( * ) Notice: Subject to any disclaimer, the term of this patent is extended or adjusted under 35 U.S.C. 154(b) by 14 days.

(21) Appl. No.: 15/031,615

(22) PCT Filed: Oct. 22, 2014

(86) PCT No.: PCT/CN2014/089174

§ 371 (c)(1),
(2) Date: Apr. 22, 2016

(87) PCT Pub. No.: WO2015/058693

PCT Pub. Date: Apr. 30, 2015

(65) Prior Publication Data

US 2016/0272364 A1 Sep. 22, 2016

(30) Foreign Application Priority Data

Oct. 22, 2013 (CN) ..... 2013 1 0501224

(51) Int. Cl.
*B65D 6/00* (2006.01)
*B65D 6/18* (2006.01)
(Continued)

(52) U.S. Cl.
CPC ..... *B65D 11/1833* (2013.01); *B65D 19/18* (2013.01); *B65D 21/086* (2013.01);
(Continued)

(58) Field of Classification Search
CPC .. B65D 11/1833; B65D 21/086; B65D 19/18; B65D 2519/00174; B65D 2519/00034;
(Continued)

(56) References Cited

U.S. PATENT DOCUMENTS 5,938,059 A 8/1999 Luburic
8,627,973 B2 * 1/2014 Dekkers ..... B65D 11/1833 220/4.28
(Continued)

FOREIGN PATENT DOCUMENTS

CN 201737375 2/2011
CN 102502124 6/2012
(Continued)

OTHER PUBLICATIONS

International Search Report for international application No. PCT/CN2014/089174, dated Jan. 8, 2015 (4 pages, including English translation).

*Primary Examiner* — Kareen Thomas
(74) *Attorney, Agent, or Firm* — Hamre, Schumann, Mueller & Larson, P.C.

(57) ABSTRACT

This invention discloses a collapsible container, comprising a base and two pairs of opposite side walls. The side walls are provided with one or more movable portions extending from the bottom of the side walls. The base is provided with one or more opening pockets, wherein the side walls are disposed in the corresponding opening pockets on the base via the movable portions. A hinge device is provided between the movable portions and the opening pockets. The hinge device comprises: hinge holes provided in the movable portions of the side walls; a guiding device provided in the opening pockets of the base; and a connecter provided with hinge pins and a sliding device to be engaged with the guiding device. The sliding device of the connecter is movable up and down in vertical direction along the guiding device in the opening pockets. The hinge pins are disposed in the hinge holes and are rotable around the hinge pins. When folded, the side walls of the collapsible container
(Continued)

according to this invention will not inclined relative to the base. In addition, the collapsible container of the invention can be detached or folded in any consequences without tool.

9 Claims, 10 Drawing Sheets

(51) Int. Cl.
*B65D 19/18* (2006.01)
*B65D 21/08* (2006.01)

(52) U.S. Cl.
CPC ..... *B65D 2519/009* (2013.01); *B65D 2519/00034* (2013.01); *B65D 2519/00069* (2013.01); *B65D 2519/00174* (2013.01); *B65D 2519/00333* (2013.01); *B65D 2519/00497* (2013.01); *B65D 2519/00587* (2013.01); *B65D 2519/00611* (2013.01); *B65D 2519/00656* (2013.01)

(58) Field of Classification Search
CPC ..... B65D 2519/00587; B65D 2519/00069; B65D 2519/00656; B65D 2519/00333; B65D 2519/00611; B65D 2519/00497; B65D 2519/009
USPC ... 220/6, 7, 4.32, 4.34, 1.5, 4.33, 4.01, 4.28; 16/337; 217/47, 65, 15
See application file for complete search history.

(56) References Cited

U.S. PATENT DOCUMENTS

| | | | | |
|---|---|---|---|---|
| 8,651,310 | B2 * | 2/2014 | Orgeldinger ..... | B65D 11/1833 220/6 |
| 8,662,333 | B2 * | 3/2014 | Orgeldinger ..... | B65D 11/1833 220/6 |
| 8,720,719 | B2 * | 5/2014 | Hug ..... | B65D 11/1833 220/4.34 |
| 2011/0259884 | A1 | 10/2011 | Kellerer et al. | |

FOREIGN PATENT DOCUMENTS

| | | |
|---|---|---|
| CN | 102530348 | 7/2012 |
| CN | 103693264 | 4/2014 |
| CN | 203568066 | 4/2014 |
| EP | 2500495 | 9/2012 |
| JP | 07251838 | 10/1995 |

* cited by examiner

COLLAPSIBLE CONTAINER

TECHNICAL FIELD

The invention relates to a collapsible container, in particular a hinge structure of the collapsible container.

BACKGROUND

The empty containers or boxes with fixed side walls need considerable storage space. Therefore, the existing container comprises collapsible side walls to reduce the corresponding volume in unloaded status. Most of these collapsible containers comprise a base in form of rectangular plate structure, wherein the collapsible side walls are coupled to the edges of the base by hinges. When the side walls are in unfolded position, the side walls are coupled to each other via interlocking buckle engagement, wherein engaging latches on one pair of opposite side walls are engaged to the engaging hooks on the other pair of opposite side walls.

For many containers, the side walls are configured to be higher than half of the width of the base, thus the opposite side walls will be overlapped when they are folded towards each other. Therefore, the side wall which is folded later will extend beyond the edge of the side wall which is folded first and will be not parallel to the base but angled. In other word, the side wall folded later is in an inclined position. When a plurality of containers are stacked one above another, corresponding bending movement of the upper side wall positioned angularly occurs, which will cause a damage or deform over time. For such containers, another defect is that several collapsed containers can not be stacked in a stable way.

In order to overcome these defects, the side walls are connected to the shaft with different heights on the sides of the base, so that the side walls are connected to the base at different heights, wherein the side walls connected at lower positions are folded firstly, then the side walls connected at higher positions are folded subsequently, and when two side walls are in folded positions, they are arranged parallel to the base.

However, the height of the opposite side walls are different, which increases the cost of manufacturing and maintaining. Further, the workers must pay more attention during the operation which will affect the efficiency to some extend, since the folding work should be executed sequentially. It needs a more advanced alternative solution to solve this problem.

SUMMARY

The object of this invention is to provide a collapsible container which can be assembled and disassembled without tool and can be folded in any consequences.

In order to achieve the above object, this invention provides a collapsible container, comprising a base and two pairs of opposite side walls, characterized in that:

each of the side walls is provided with one or more movable portions extending from the bottom of the side walls, and the base is provided with one or more opening pockets, wherein the side walls are positioned in the corresponding opening pockets on the base via the movable portions;

a hinge device is provided between the movable portions and the opening pockets, wherein the hinge device comprises: hinge holes provided in the movable portions of the side walls; a guiding device provided in the opening pockets of the base; and a connecter provided with hinge pins and a sliding device to be engaged with the guiding device; wherein, the connecter is movable up and down in vertical direction along the guiding device in the opening pockets via the sliding device, and the hinge pins are disposed in the hinge holes and enable the side walls to be rotated around the hinge pins.

Preferably, according to the collapsible container of the invention, an interlocking device is disposed between at least one side wall and the base, so that the interlocking device prevents the side wall from moving in vertical direction relative to the base when the side wall is in erected status relative to the base, and the interlocking device between the side wall and the base is releasable through the rotation of the side wall around the hinge pins.

According to one embodiment of the invention, the sliding device on the connecter is a through hole in the center thereof; the hinge pins are located perpendicular to the axis of the through hole on one or two sides of the connecter; and the guiding device in the opening pockets of the base is a vertical cylinder capable of passing through the through hole, so that the connecter is movable along the axis of the cylinder.

According to anther embodiment of the invention, the sliding device of the connecter is a straight wall disposed on one end of the connecter; the hinge pins are located at the other end of the connecter and perpendicular to the straight wall; and the guiding device in the opening pocket is a straight slot perpendicular to a plane of the base, wherein the straight wall is slidable along the straight slot, so that the connecter is movable along the straight slot.

Preferably, the opening pockets in the base are provided with lateral shoulders with a lateral distance $H_2$ from the end surface thereof to the axis of the hinge pin; wherein a distance from the external edge of the movable portion of the side wall disposed in the opening pocket to the axis of the hinge pin is larger than $H_2$.

Preferably, the movable portion is provided with a recess at the lower portion thereof; the hinge hole is an arc profile disposed at the root of the recess; and a narrowed segment is provided between the arc profile and an opening of the recess, so as to prevent the hinge pin from easily dropping off after entering into the recess.

Preferably, the interlocking device comprises ledges provided on the two sides of the movable portion and grooves on the base for engaging with the ledges, so as to restrict a movement of the side wall in vertical direction relative to the base when the side wall is in erected status.

Preferably, the movable portion is provided with an inclined ramp, when connected, the vertical distance from the ramp to the axis of the hinge pin of the connecter is no greater than the vertical distance $H_2$ from the axis of the hinge pin to an end surface of the shoulders on the base.

Preferably, the movable portion is provided with a slot at a bottom end on one side thereof, and the base is provided with a baffle, wherein the slot allows the baffle of the base to be received therein when the side walls are erected, so as to restrict the side walls from moving inwardly when suffering external force.

Preferably, the collapsible container is IBC.

When folded, the side walls of the collapsible container according to this invention will not inclined relative to the base. In addition, the collapsible container of the invention can be detached or folded in my consequences without tool.

DETAILED DESCRIPTION

Figure 1:
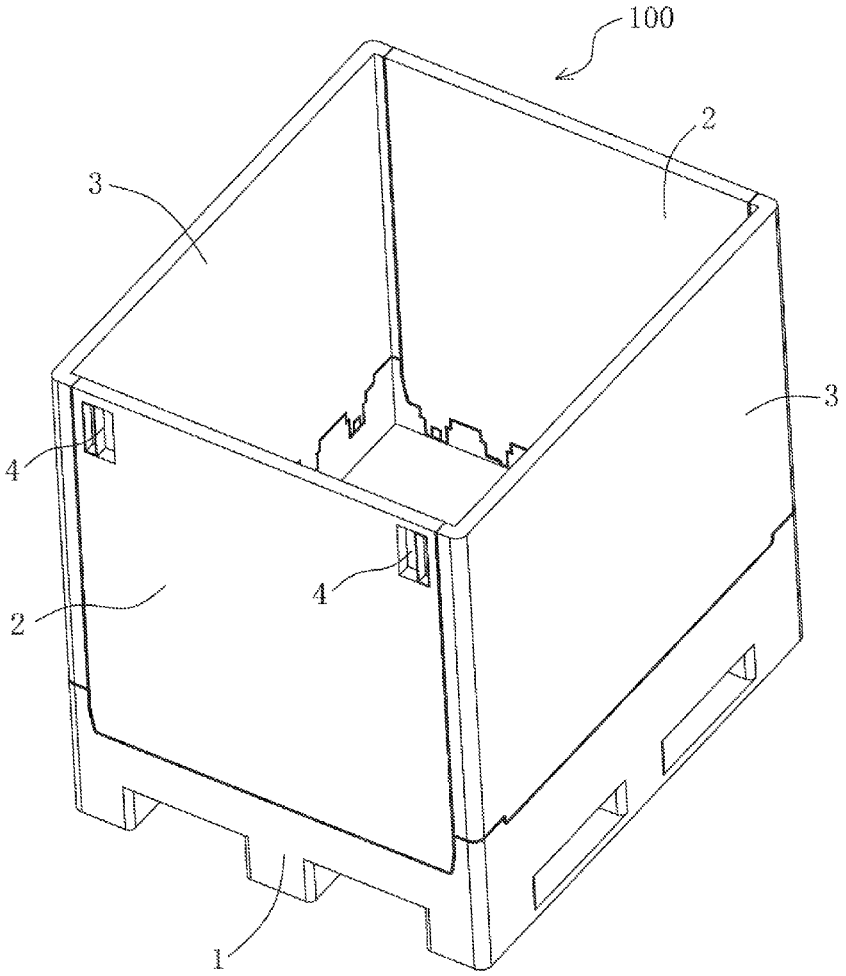
FIG. 1 shows a perspective structural view of a general collapsible container.
Figure 2:
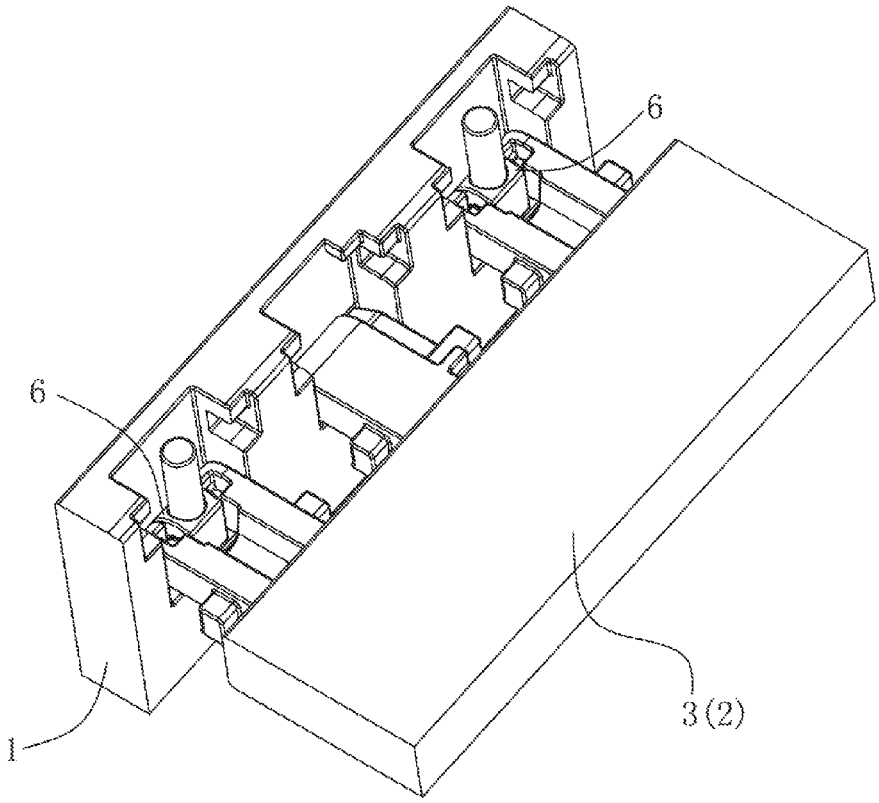
FIG. 2 shows a structure of connection between the side wall and the base according to the first embodiment of this invention.

The preferred embodiments of the invention will be described in detail with the reference to the drawing in the following, in order to more clearly understand the purpose, the features and advantages of the present invention. It should be understood that the embodiments shown in the drawings are not to limit the scope of the invention, but merely to illustrate the substantive spirit of the technical solution of the present invention.

FIG. 1 shows a perspective structural view of a general collapsible container. As shown in FIG. 1, a collapsible container 100 comprises a base 1, two pairs of side walls 2 and 3, and locks 4 for maintaining the side walls 2 and 3 in erected positions. When the container are transported in unloaded status, the locks 4 between side walls 2 and 3 are unlocked, then the side walls 2 and 3 are folded towards the interior of the container, so that the height of the container is reduced significantly and the transportation cost is saved.

FIGS. 2-7 show the structure of connection between the side wall and the base according to the first embodiment of this invention. As shown in FIGS. 2-5, the side walls 2 and 3 are provided with one or more movable portions 31 at the bottom thereof. The side walls 2 and 3 can be disposed in one or more corresponding opening pockets 11 in the base 1 via one or more movable portions 31. Then, the side walls 2 and 3 and the base 1 are interconnected via the hinge device between the opening pockets 11 and the movable portions 31. The hinge device comprises a connecter 6 with a through hole 62 (round, square, and the like) in the center thereof and hinge pins 61 perpendicular to the axis of the through hole 62 on two or one sides of the connecter. The movable portions 31 of the side walls are provided with holes for receiving the hinge pins on the connecter 6, so that the side walls can be rotated around the hinge pins. The base 1 is provided with a vertical cylinder 12 in an opening pocket 11 which can pass through the through hole 62 of the connecter, so that the connecter is movable along the central axis of the cylinder 12, i.e. in vertical direction.

Figure 3:
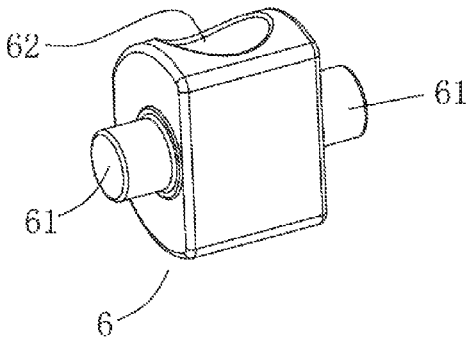
FIG. 3 is a perspective structural view of the connecter in FIG. 2.

The specific structure of the connecter 6 shown its FIG. 3. The connecter is provided with a circular through hole 62 and a hinge pin 61 on each side thereof. The two hinge pins 61 are coaxial and perpendicular to the axis of the through hole 62.

Figure 4:
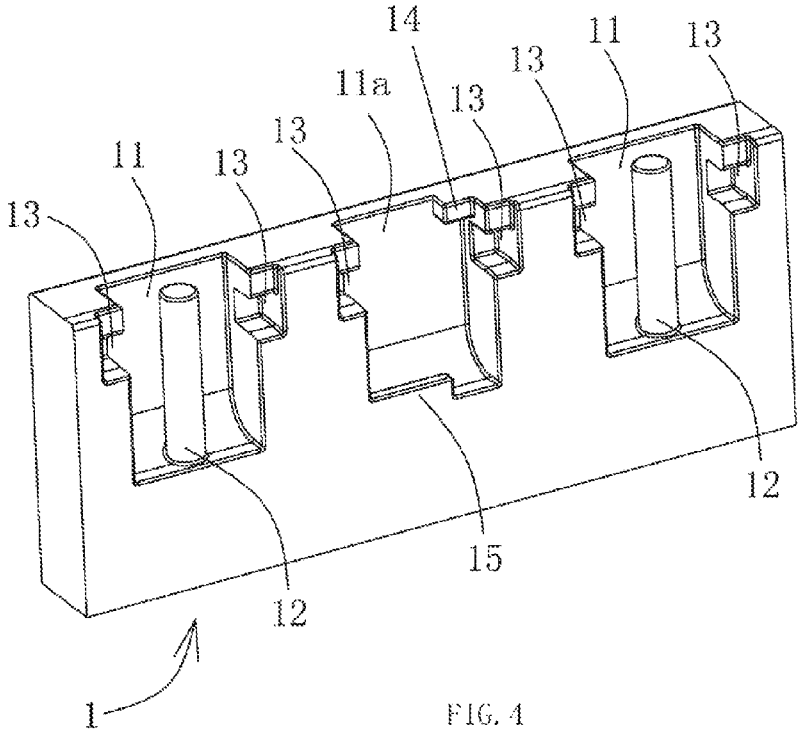
FIG. 4 shows a perspective structural view of the connection portion of the base according to the first embodiment of this invention.

FIG. 4 shows a perspective structural view of the connection portion between the base and the side walls. As shown, in FIG. 4, the base 1 is provided with opening pockets 11 and 11*a*. Each of the opening pockets 11 and 11*a* is provided with grooves 13 on two sides thereof. Each of the opening pockets 11 is provided with a cylindrical pin 12 inside thereof. The cylindrical pin can pass through the hole 62 of the connecter 6, so that the connecter 6 is movable along the axis of the cylinder pin 12. The opening pocket 11*a* is provided with lateral shoulders 14 on the top thereof and a baffle 15 on the bottom thereof. It shall be noted that, the relative arrangement of the opening pocket 11 and the opening pocket 11*a* can be changed. For example, in FIG. 4, the left opening pocket can be an opening pocket 11*a*, and the middle one can be an opening pocket 11.

Figure 5:
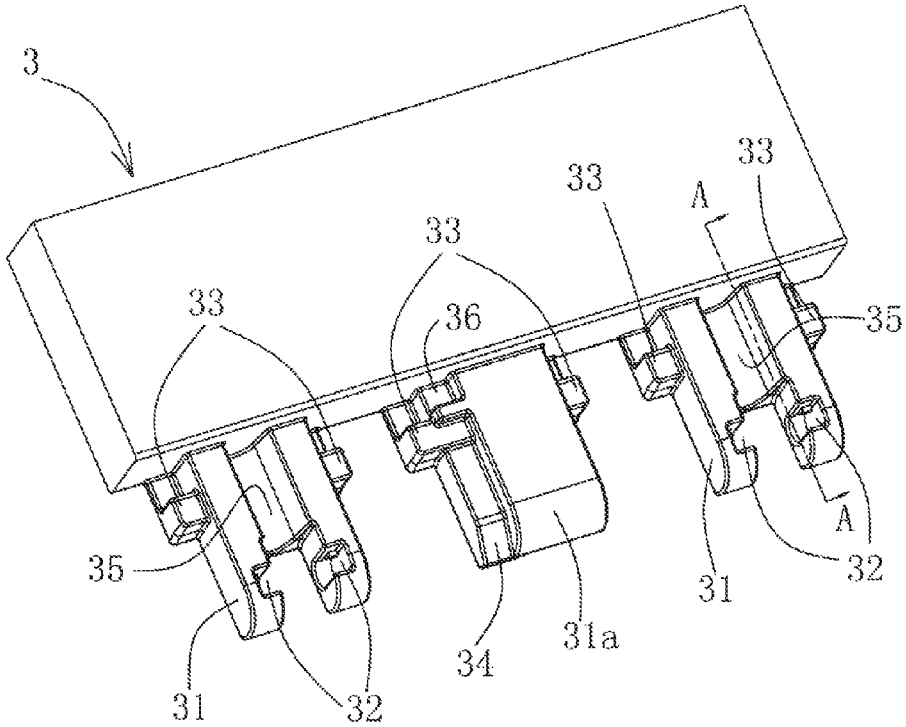
FIGS. 5-6 show a perspective structural view of the connection portion of the side wall according to the first embodiment of this invention.
Figure 6:
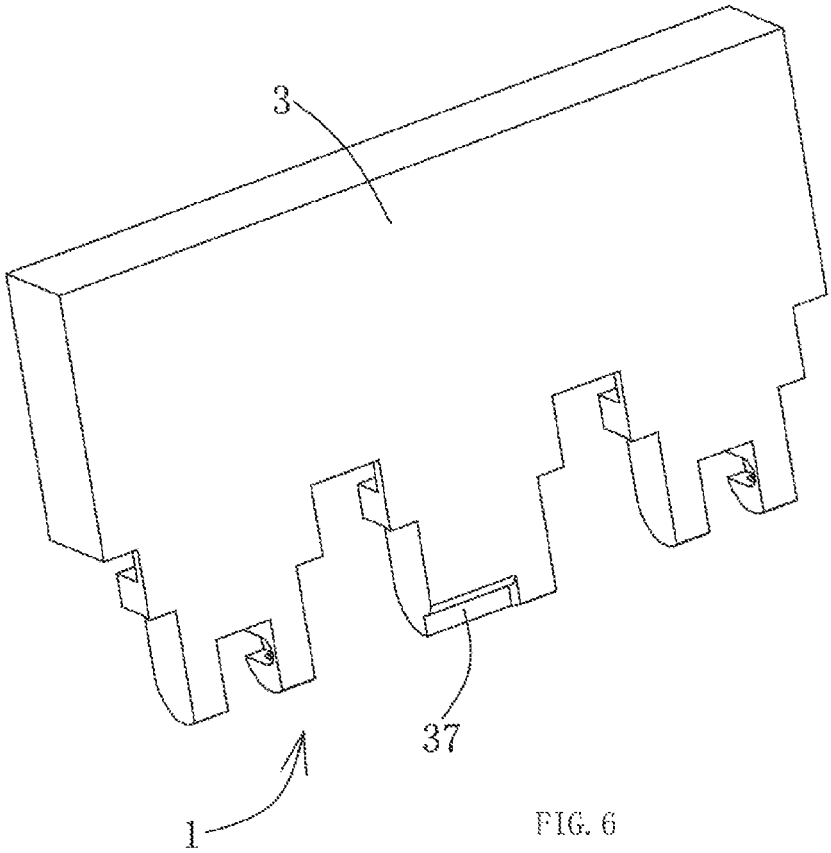
Figure 7:
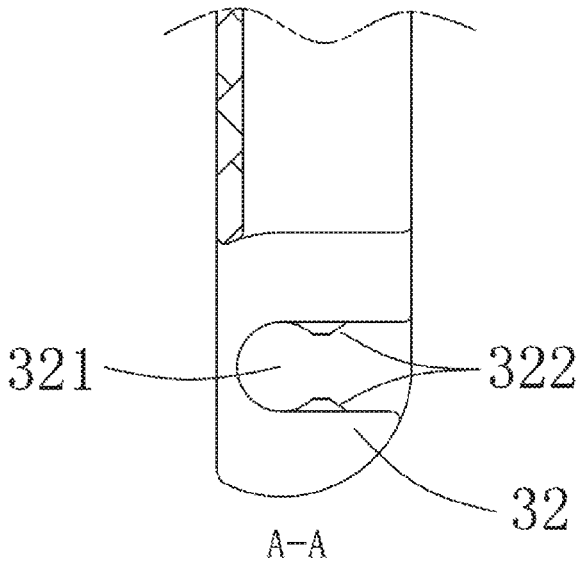
FIG. 7 is a partial section view along line A-A in FIG. 5 of the connection portion of the side wall.

FIGS. 5-7 show the structure of the connection portion on the side walls, wherein FIG. 7 is a partial section view. As shown in FIGS. 5-7, the bottom of the side wall 3 has movable portions 31 and 31*a* extending therefrom with a ledge 33 at each side thereof. The ledge 33 can be cooperated with the groove 13 on the base 1. That is, the ledges 33 can enter into the groove 13 when the side walls 3 are in erected status, so as to restrict a vertical movement of the side wall 3 relative to the base 1 in such status. The side of movable portion 31 is provided with a slot 35 in the central portion thereof for receiving the cylinder pin 12 and with a recess 32 in the lower portion thereof. The specific structure of the recess 32 is shown in the sectional view of FIG. 7. The recess has an are profile 321 at the root for accommodating the hinge pin 62 of the connecter. A narrowed segment 322 is provided between the profile 321 and the opening of the recess 32, so that the hinge pin 62 in the recess 32 can not drop off easily.

The movable portion 31*a* is provided with an inclined ramp 34 and a recess 36 above the ramp 34. When connected, the vertical distance $H_1$ from the ramp 34 to the axis of the hinge pin 62 of the connecter 6 is no greater than the vertical 117 from the axis of the hinge pin 62 to the end surface of the shoulder 14 on the base 1 (see FIG. 11). In addition, as shown in FIG. 7, the movable portion 31*a* is provided with a slot 37 at the bottom end on the other side. The slot 37 allows the baffle 15 to be received therein when the side walls 2 and 3 are erected (see FIG. 11), so as to restrict the side walls 2 and 3 from moving inwardly when suffering external force.

Figure 8:
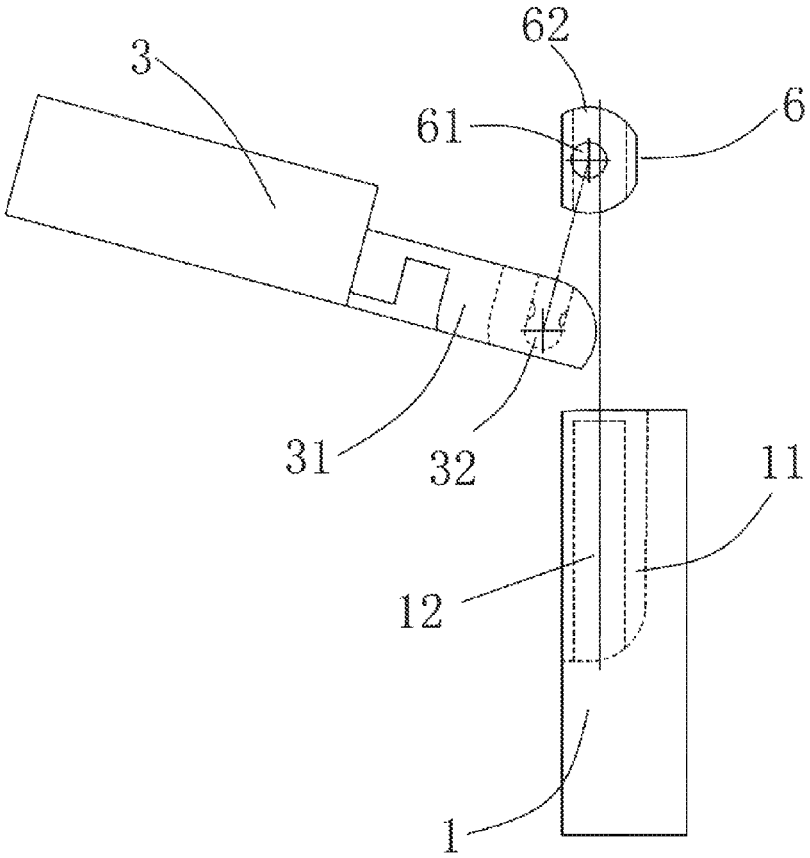
FIG. 8 shows an assembling relationship among the side wall, the base and the connecters.

The cooperation among the side walls 2 and 3, the base 1 and the connecter 6 is shown in FIG. 8. It shall be noted that, the hinge pins 61 of the connecter 6 can be mounted in the recess 32 of the side walls 3 in many ways, for example, through interference fit by pressing the hinge pins 61 into the recess 32 due to the flexibility of the plastic member, or forming a ramp on the hinge pin 61 at the non-working angle position with a width less than the width of the narrowed segment 322, or dividing the hinge pin 61 into separate components so that they can be inserted laterally. The purpose of the above solutions is that the side walls 2 and 3 can be rotated relative to the connecter 6 and the connecter 6 is interconnected with the side walls 2 and 3 when the side walls are in working position. Likewise, the shapes of the holes 62 in the connecter 6 and the cylinder pin on the base 1 can vary in practice, such as square, oval, and the like. The side walls can also be connected to the base 1 by various means such as consequent assembling or inserting inserts, as long as side walls 2 and 3 can move relative to the base 1 up and down in non-erected status and maintain connection with the base 1 in a certain movement distance.

Figure 9:
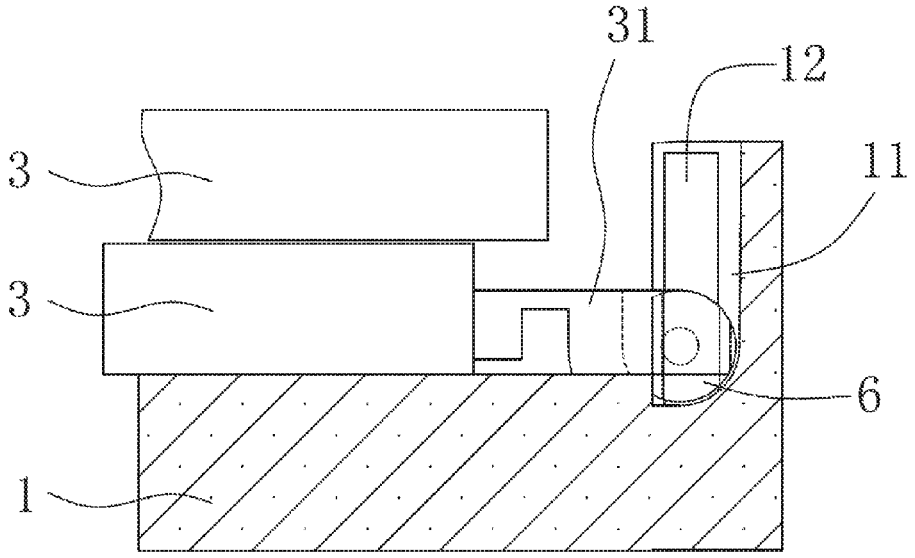
FIGS. 9 and 10 show the positions of moving portions extending from opposite side walls on the base when the opposite side walls are folded in different sequences.
Figure 10:
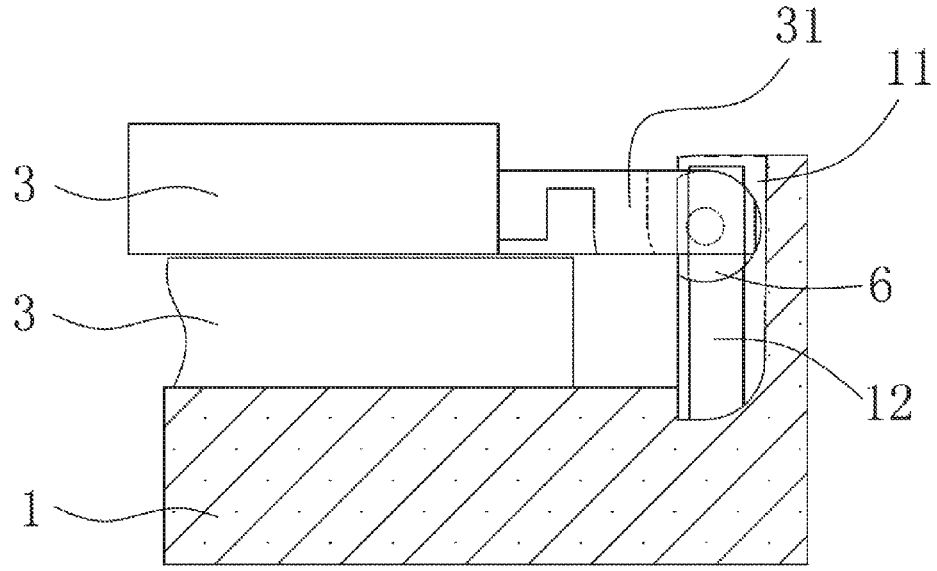

FIGS. 9 and 10 show the positions in the base 1 of the movable portions 31 of opposite side walls 2 and 3 in different folding sequences. Taking the side wall 2 as an example, both earlier and later folding sequences allow it overlaps with the base 1 flatly and snugly. The difference is that the movable portion of the side wall 2 which is folded later in the base 1 offsets upwardly a distance by about the thickness of one side wall.

Figure 11:
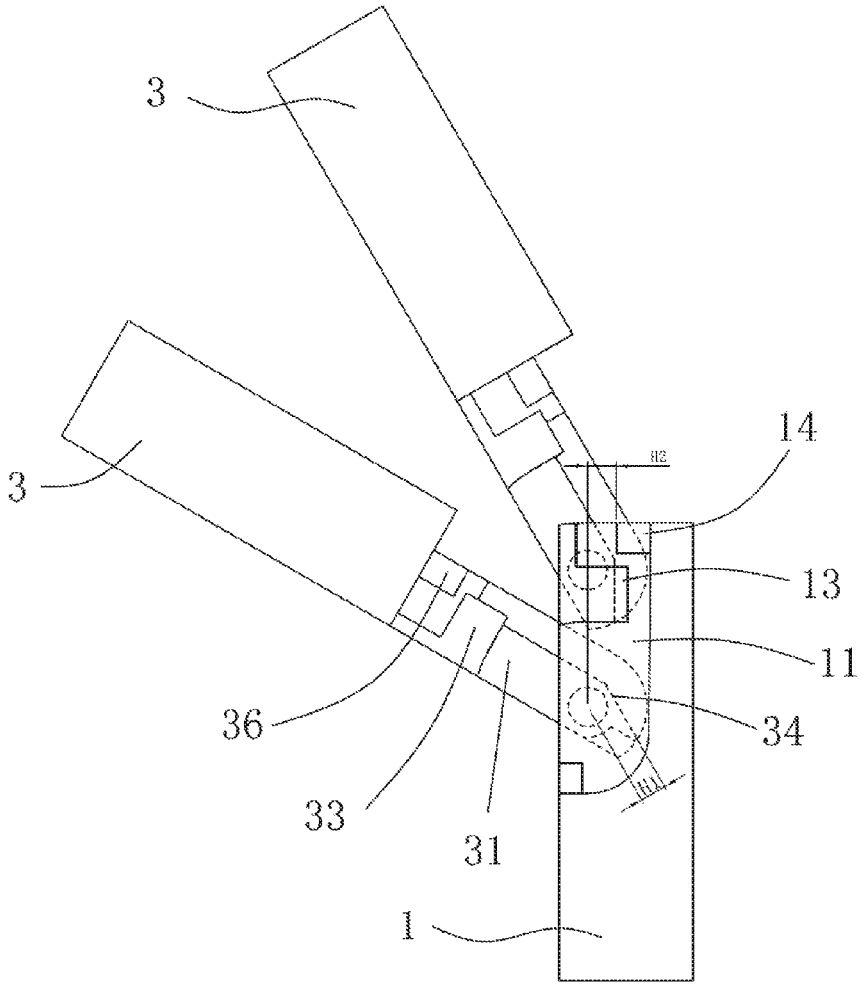
FIG. 11 shows an unfolding process of the side wall.
Figure 12:
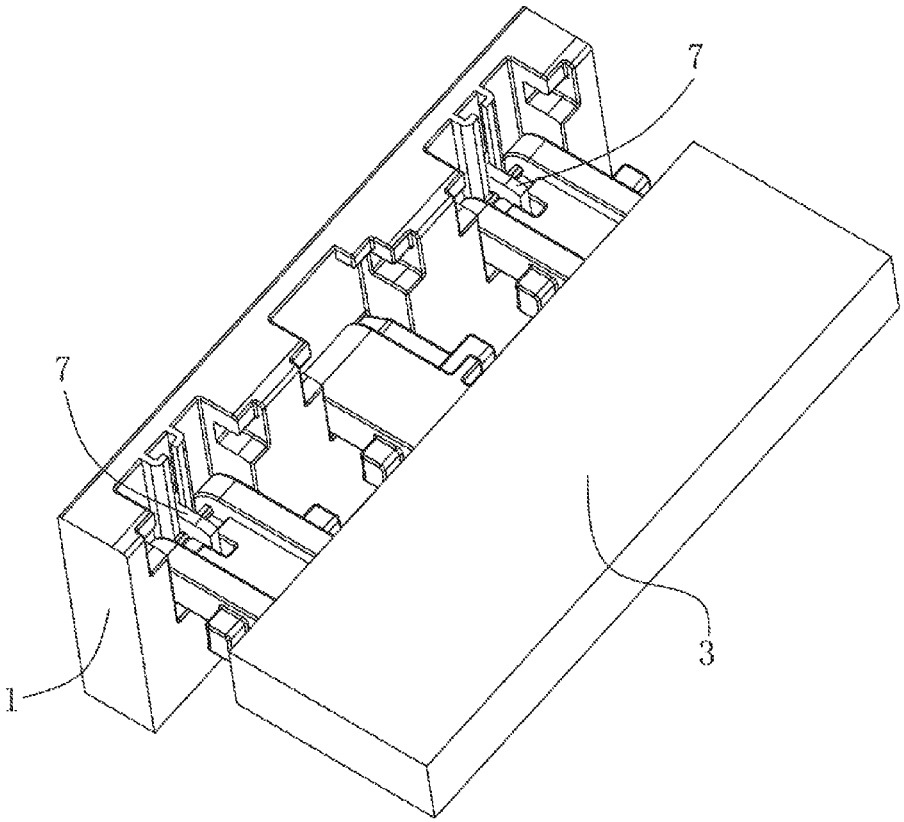
FIGS. 12-15 show the structure of connection between the side wall and the base according to the second embodiment of this invention.
Figure 13:
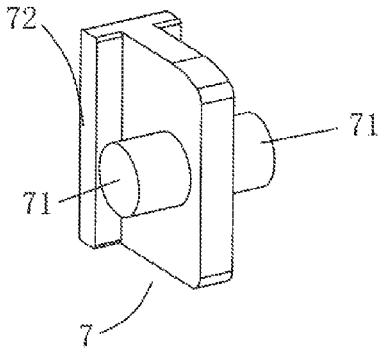
Figure 14:
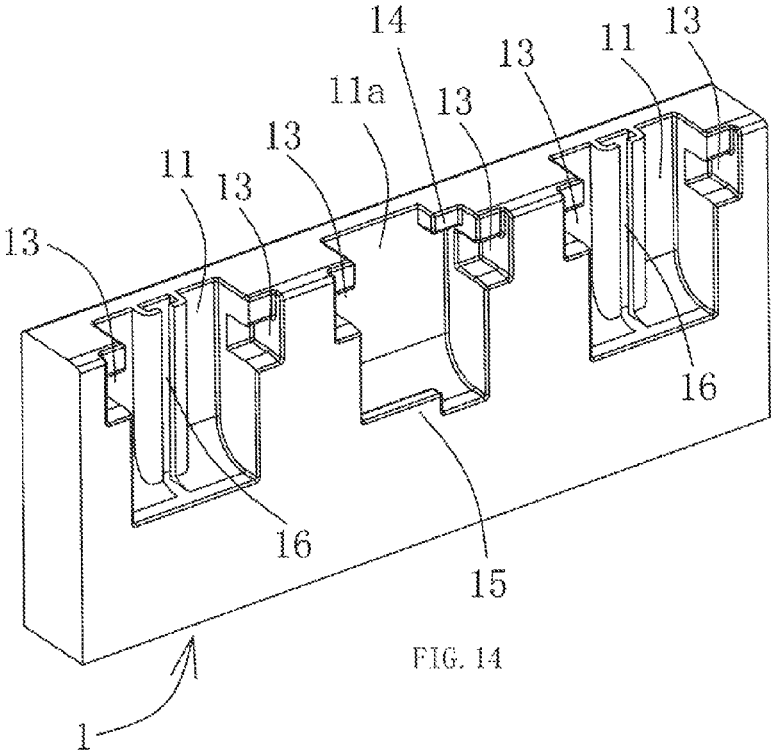
Figure 15:
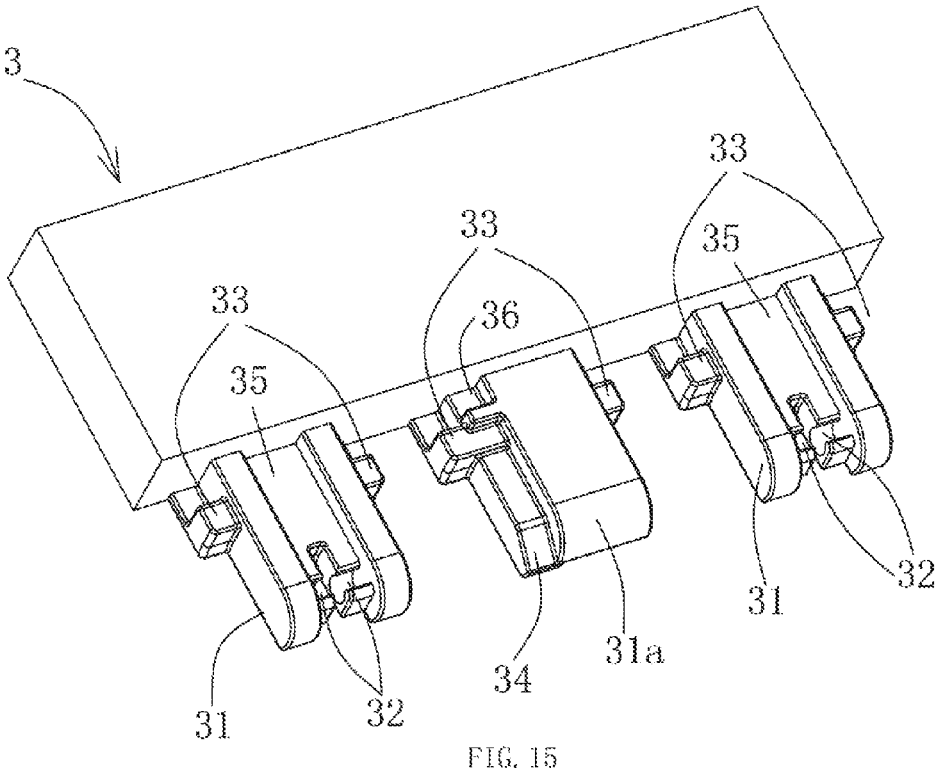
Figure 16:
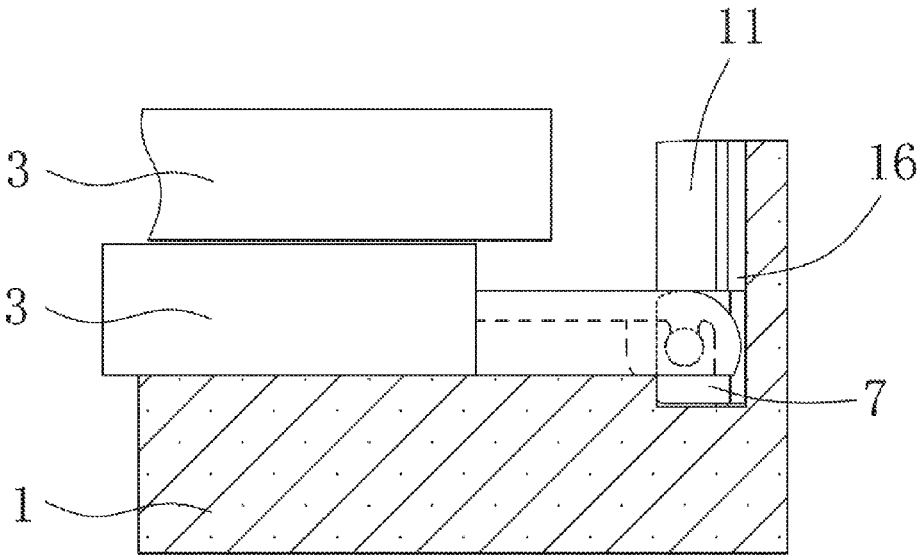
FIGS. 16-17 are the structural views of collapsed container with side walls folded in different sequences respectively.
Figure 17:
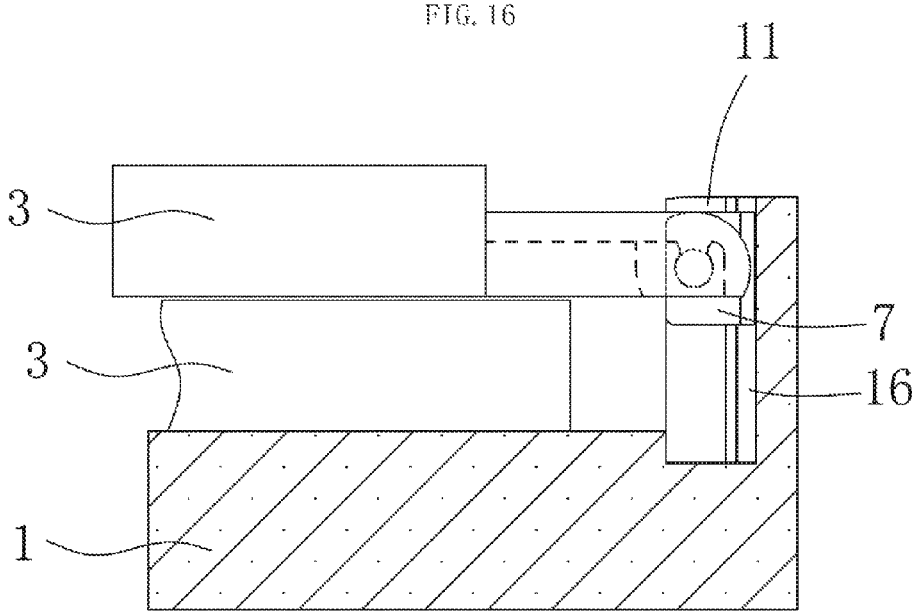

Other than FIGS. 9 and 10, FIG. 11 shows the relationship among features during the rotation of the side walls relative to the base. Taking the side wall 3 as an example, it is known that the above structure enables the movable portion 31 to move up and down in the opening pocket 11 of the base 1. The side wall 3 can be rotated around the hinge pins 61 of the connecter 6, as shown in figures. Assuming the distance from the ramp 34 on the movable portion 31 to the axis of the hinge pins 61 is set as 7 mm, and the vertical distance from the end surface on the shoulders 14 of the opening pocket 11 to the axis of the hinge pins 61 is set as 7.5 mm, then when the side wall 3 is rotated by a certain angle for example 60 degrees, the ramp 34 is substantially in an erected status, enabling the movable portion 31 to avoid the shoulders 14. If it is required to detach the side wall 3, the base 1 is disconnected with the side wall by only pulling the side wall 3 upwardly further so that it can be disengaged from the opening pocket 11. When the side wall 3 is normally rotating within other angle range, the shoulders 14 can always restrict the movable portions 31 from leaving the opening pockets 11 in the base 1, so as to ensure the connection between the side wall 3 and the base during folding and unfolding. The ledges 33 can be received in the grooves 13 when the side wall 3 is in erected status, so as to restrict the side wall 3 from moving in vertical direction relative to the base 1. Further, the ledges 33 can be disengaged from the grooves 13 by only rotating the side wall 3 inwardly. The recess 36 can engage with the shoulders 14 in the same way, so as to improve the locking strength between the side wall 3 and the base 1 in vertical direction.

FIGS. 12-17 show the structure of connection between the side wall and the base according to the second embodiment of this invention. As shown in FIGS. 12-17, the difference between this embodiment and the first embodiment lies in that, the structure enabling the movable portions 31 of the side wall 3 to move up and down in the opening pockets 11 of the base 1 is varied as a straight wall 72 provided on a connecter 7 and a straight slot 16 provided on the base (the corresponding structures in the embodiment shown in FIGS. 2-7 are the hole 62 and the cylindrical pin 11). The straight wall 72 can be inserted into the straight slot 16 and moves up and down along it. The straight wall 72 is provided on one end of the connecter 7, and the hinge pins 71 are provided on the other end of the connecter 7 and perpendicular to the straight wall 72. The remaining features are the same, and the description thereof is not described again.

It should be noted that, in the above embodiments, the engagement structure between the connecter and the opening pocket of the base can employ other engagement structures other than the hole-cylinder pin and the straight wall-straight slot, provided that the connecter can moves up and down in vertical direction in the opening pockets of the base. Indeed, it can works provided that the opening pockets of the base are provided with guiding device, and the connecters are provided with sliding device engaging with the guiding device, enabling the sliding device on the connecter to move up and down in vertical direction along the guiding device in the opening pockets.

When folded, the side walls of the collapsible container according to this invention will not inclined relative to the base. In addition, the collapsible container of the invention can be detached or folded in any consequences without tool.

This invention is suitable for large containers, especially large collapsible transferring containers. The large container herein is a container with volume over 800 L.

The preferred embodiments of the present invention have been described in detail above. However, it should be understood that after reading the foregoing teachings of the present invention, those skilled in the art may make various modifications of the present invention or modifications. These equivalents are within the scope of the appended claims.

What is claimed is:

1. A collapsible container, comprising a base and two pairs of opposite side walls, wherein:

each of the side walls is provided with one or more movable portions extending from a bottom of the side walls, and the base is provided with one or more opening pockets, wherein the side walls are positioned in corresponding opening pockets on the base via the movable portions;

a hinge device is provided between the movable portions and the opening pockets, wherein the hinge device comprises: hinge holes provided in the movable portions of the side walls; a guiding device provided in the opening pockets of the base; and a connecter provided with hinge pins and a sliding device to be engaged with the guiding device; wherein, the connecter is movable up and down in a vertical direction along the guiding device in the opening pockets via the sliding device, and the hinge pins are disposed in the hinge holes and enable the side walls to be rotated around the hinge pins.

2. The collapsible container according to claim 1, wherein an interlocking device is disposed between at least one side wall and the base, so that the interlocking device prevents the side wall from moving in vertical direction relative to the base when the side wall is in erected status relative to the base, and the interlocking device between the side wall and the base is releasable through the rotation of the side wall around the hinge pins.

3. The collapsible container according to claim 1, wherein the sliding device on the connecter is a through hole in the center thereof; the hinge pins are located perpendicular to an axis of the through hole on one or two sides of the connecter; and the guiding device in the opening pockets of the base is a vertical cylinder capable of passing through the through hole, so that the connecter is movable along an axis of a cylinder.

4. The collapsible container according to claim 1, wherein the sliding device on the connecter is a straight wall disposed on one end of the connecter; the hinge pins are located at an other end of the connecter and perpendicular to the straight wall; and the guiding device in the opening pocket is a straight slot perpendicular to a plane of the base, wherein the straight wall is slidable along the straight slot, so that the connecter is movable along the straight slot.

5. The collapsible container according to claim 1, wherein the opening pockets in the base are provided with lateral shoulders with a lateral distance $H_2$ from an end surface thereof to an axis of the hinge pins; wherein a distance from an external edge of the movable portion of the side walls disposed in the opening pocket to the axis of the hinge pin is larger than $H_2$.

6. The collapsible container according to claim 1, wherein the movable portion is provided with a recess at a lower portion thereof; the hinge hole is an arc profile disposed at a root of the recess; and a narrowed segment is provided between the arc profile and an opening of the recess, so as to prevent the hinge pins from easily dropping off after entering into the recess.

7. The collapsible container according to claim 2, wherein the interlocking device comprises ledges provided on the two sides of the movable portion and grooves on the base for engaging with the ledges, so as to restrict a movement of the side wall in vertical direction relative to the base when the side wall is in erected status.

8. The collapsible container according to claim 1, wherein the movable portion is provided with an inclined ramp, when connected, a vertical distance from the ramp to an axis of the hinge pins of the connecter is no greater than a vertical distance $H_2$ from the axis of the hinge pin to an end surface of a shoulder on the base.

9. The collapsible container according to claim 1, wherein the movable portion is provided with a slot at a bottom end on one side thereof, and the base is provided with a baffle, wherein the slot allows the baffle of the base to be received therein when the side walls are erected, so as to restrict the side walls from moving inwardly when suffering external force.

* * * * *